US007559207B2

(12) United States Patent
Knight et al.

(10) Patent No.: US 7,559,207 B2
(45) Date of Patent: Jul. 14, 2009

(54) METHOD FOR REFRIGERANT PRESSURE CONTROL IN REFRIGERATION SYSTEMS

(75) Inventors: John Terry Knight, Moore, OK (US); Anthony William Landers, Yukon, OK (US); Patrick Gordon Gavula, Oklahoma City, OK (US); Stephen Blake Pickle, Norman, OK (US)

(73) Assignee: York International Corporation, York, PA (US)

( * ) Notice: Subject to any disclaimer, the term of this patent is extended or adjusted under 35 U.S.C. 154(b) by 667 days.

(21) Appl. No.: 11/159,878

(22) Filed: Jun. 23, 2005

(65) Prior Publication Data

US 2006/0288716 A1 Dec. 28, 2006

(51) Int. Cl.
*F25B 41/00* (2006.01)

(52) U.S. Cl. ..... 62/196.4; 62/115

(58) Field of Classification Search ..... 62/196.4, 62/115, 176.6, 197, 199, 504, 507
See application file for complete search history.

(56) References Cited

U.S. PATENT DOCUMENTS

| | | | |
|---|---|---|---|
| 2,154,136 | A | 4/1939 | Parcaro |
| 2,172,877 | A | 9/1939 | Parcaro |
| 2,195,781 | A | 4/1940 | Newton |
| 2,196,473 | A | 4/1940 | Ploeger |
| 2,200,118 | A | 5/1940 | Miller |
| 2,237,332 | A | 4/1941 | Bretzlaff et al. |
| 2,451,385 | A | 10/1948 | Groat |
| 2,515,842 | A | 7/1950 | Swinburne |
| 2,564,310 | A | 8/1951 | Nussbaum et al. |
| 2,679,142 | A | 5/1954 | McGrath |
| 2,682,758 | A | 7/1954 | Harris |
| 2,702,456 | A | 2/1955 | Ringquist et al. |
| 2,715,320 | A | 8/1955 | Wright |
| 2,729,072 | A | 1/1956 | Dybvig |
| 2,734,348 | A | 2/1956 | Wright |
| 2,770,100 | A | 11/1956 | Raney |
| 2,844,946 | A | 7/1958 | Bauer |

(Continued)

FOREIGN PATENT DOCUMENTS

| | | |
|---|---|---|
| WO | WO-92/16692 | 10/1992 |
| WO | WO/96/39603 | 12/1996 |
| WO | WO-03/006890 A1 | 1/2003 |
| WO | WO-03/054457 A1 | 7/2003 |

OTHER PUBLICATIONS

Sporlan, 3-Way Valves (Installation and Servicing Instructions), Sporlan Valve Company, Washington, MO Jun. 2001 / Bulletin 30-21.

(Continued)

*Primary Examiner*—Chen-Wen Jiang
(74) *Attorney, Agent, or Firm*—McNees Wallace & Nurick, LLC

(57) ABSTRACT

A method and system for controlling refrigerant pressure in an HVAC system. The method includes providing a compressor, a condenser and an evaporator connected in a closed refrigerant loop. The condenser has a header arrangement capable of distributing refrigerant to a plurality of refrigerant circuits within the condenser. The header arrangement also is capable of selectively isolating at least one of the circuits from refrigerant flow. Refrigerant pressure is sensed at a predetermined location in the refrigeration system. At least one of the circuits is isolated when the refrigerant pressure is less than or equal to a predetermined pressure.

22 Claims, 7 Drawing Sheets

U.S. PATENT DOCUMENTS 2,874,550 A 2/1959 Musson
2,932,178 A 4/1960 Armstrong et al.
2,940,281 A 6/1960 Armstrong
2,952,989 A 9/1960 Gould et al.
2,961,844 A 11/1960 McGrath
2,963,877 A 12/1960 Malkoff et al.
3,012,411 A 12/1961 Kjellman
3,026,687 A 3/1962 Robson
3,060,699 A 10/1962 Tilney
3,067,587 A 12/1962 McFarlan
3,105,366 A 10/1963 Atchison
3,119,239 A 1/1964 Sylvan
3,139,735 A 7/1964 Malkoff et al.
3,203,196 A 8/1965 Malkoff
3,248,895 A 5/1966 Mauer
3,264,840 A 8/1966 Harnish
3,293,874 A 12/1966 Gerteis
3,316,730 A 5/1967 Lauer
3,320,762 A 5/1967 Murdoch
3,358,469 A 12/1967 Quick
3,362,184 A 1/1968 Jensen
3,370,438 A * 2/1968 Hopkinson ..... 62/196.4
3,402,564 A 9/1968 Nussbaum
3,402,566 A 9/1968 Leimbach
3,460,353 A 8/1969 Ogata et al.
3,469,412 A 9/1969 Giuffre
RE26,695 E 10/1969 Jenson
3,481,152 A * 12/1969 Seeley ..... 62/196.4
3,520,147 A 7/1970 Glackman
3,525,233 A 8/1970 Pond
3,540,526 A 11/1970 Hoaglund et al.
3,631,686 A 1/1972 Kautz
RE27,522 E 11/1972 Schenk et al.
3,738,117 A 6/1973 Engel
3,779,031 A 12/1973 Akiyama et al.
3,798,920 A 3/1974 Morgan
3,921,413 A 11/1975 Kohlbeck
4,012,920 A 3/1977 Kirschbaum
4,018,584 A 4/1977 Mullen
4,089,368 A 5/1978 Bell, Jr. et al.
4,105,063 A 8/1978 Bergt
4,182,133 A 1/1980 Haas et al.
4,184,341 A 1/1980 Friedman
4,189,929 A 2/1980 Russell
4,270,362 A 6/1981 Lancia et al.
4,287,722 A 9/1981 Scott
4,328,682 A 5/1982 Vana
4,350,023 A 9/1982 Kuwabara et al.
4,430,866 A 2/1984 Willitts
4,448,597 A 5/1984 Kuwabara et al.
4,476,690 A 10/1984 Iannelli
4,502,292 A 3/1985 Ares et al.
4,517,810 A 5/1985 Foley et al.
4,557,116 A 12/1985 Kittler
4,566,288 A 1/1986 O'Neal
4,667,479 A 5/1987 Doctor
4,711,094 A 12/1987 Ares et al.
4,738,120 A 4/1988 Lin
4,761,966 A 8/1988 Stark
4,785,640 A 11/1988 Naruse
4,803,848 A 2/1989 LaBrecque
4,815,298 A 3/1989 Van Steenburgh, Jr.
4,862,702 A 9/1989 O'Neal
4,920,756 A 5/1990 Howland et al.
4,942,740 A 7/1990 Shaw et al.
4,984,433 A 1/1991 Worthington
5,005,379 A 4/1991 Brown
5,031,411 A 7/1991 Gehring et al.
5,065,586 A 11/1991 Shapiro-Baruch
5,088,295 A 2/1992 Shapiro-Baruch
5,123,263 A 6/1992 Gustafson
5,181,552 A 1/1993 Eiermann
5,231,845 A 8/1993 Sumitani et al.
5,277,034 A 1/1994 Hojo et al.
5,305,822 A 4/1994 Kogetsu et al.
5,309,725 A 5/1994 Cayce
5,329,782 A 7/1994 Hyde
5,337,577 A 8/1994 Eiermann
5,355,690 A 10/1994 Iritani et al.
5,400,607 A 3/1995 Cayce
5,493,871 A 2/1996 Eirmann
5,622,057 A 4/1997 Bussjager et al.
5,651,258 A 7/1997 Harris
5,664,425 A 9/1997 Hyde
5,666,813 A 9/1997 Brune
5,682,754 A 11/1997 Groenewold
5,689,962 A 11/1997 Rafalovich
5,743,098 A 4/1998 Behr
5,752,389 A 5/1998 Harper
5,802,862 A 9/1998 Eiermann
5,823,006 A 10/1998 Jung
5,826,433 A 10/1998 Dube
5,826,434 A 10/1998 Belding et al.
5,845,702 A 12/1998 Dinh
5,915,473 A 6/1999 Ganesh et al.
5,953,926 A 9/1999 Dressler et al.
5,983,652 A 11/1999 Iritani et al.
5,992,160 A 11/1999 Bussjager et al.
5,992,161 A 11/1999 O'Halloran et al.
5,996,365 A 12/1999 Tanaka
6,021,644 A 2/2000 Ares et al.
6,055,818 A 5/2000 Valle et al.
6,122,923 A 9/2000 Sullivan
6,123,147 A 9/2000 Pittman
6,167,714 B1 1/2001 Baffes
6,212,892 B1 4/2001 Rafalovich
6,260,366 B1 7/2001 Pan
6,298,680 B1 10/2001 Chopko et al.
6,332,496 B1 12/2001 Takano et al.
6,338,254 B1 1/2002 Alsenz
6,347,527 B1 2/2002 Bailey et al.
6,385,985 B1 5/2002 Bussjager et al.
6,386,281 B1 5/2002 Ganesh et al.
6,389,825 B1 5/2002 Wightman
6,389,833 B1 5/2002 Bouloy
6,418,735 B1 * 7/2002 Sienel ..... 62/115
6,422,308 B1 7/2002 Okawara et al.
6,427,461 B1 8/2002 Whinery et al.
6,508,066 B1 1/2003 Mierins et al.
6,644,049 B2 11/2003 Alford
6,644,052 B1 11/2003 Wightman
6,658,874 B1 12/2003 Trent
6,666,040 B1 12/2003 Groenewold et al.
6,705,093 B1 3/2004 Taras et al.
6,792,767 B1 9/2004 Pargeter et al.
6,826,921 B1 12/2004 Uselton
2002/0125333 A1 9/2002 Ganesh et al.
2002/0170302 A1 11/2002 Bagley
2003/0177779 A1 9/2003 Loke
2006/0288713 A1 * 12/2006 Knight et al. ..... 62/176.6

OTHER PUBLICATIONS

Sporlan, 3-Way Valves (The Right Solenoid Valve for any job), Sporlan Valve Company, Washington, MO Jun. 2001 / Bulletin 30-20.

Sporlan, Type 5D Three-Way Heat Reclaim Valve for Refrigerants 12-22-134a-502, Sporlan Valve Company, Washington, MO Dec. 1995 / Bulletin 30-10-1.

Sporlan, Solenoid Valves, Sporlan Valve Company, Washington, MO Jan. 1993 / Bulletin 30-10.

Lennox Industries Inc., Lennox Engineering Data, Bulletin No. 210317, Aug. 2003, pp. 1-40.

Lennox Industries Inc., Lennox Engineering Data, Bulletin No. 210318, Sep. 2003, pp. 1-59.
FHP Manufacturing, Technical Topics; Catalog Section: Hot Gas Reheat, Sep. 2001, pp. 1-4.
FHP Manufacturing, Hot Gas Reheat Humidimiser Application Manual, Rev. Apr. 2001, pp. 1-4.
Desert Aire, Technical Bulletin 16, 100% Outside Air Dehumidification Methods, 119 Jul. 2002, pp. 1-6.
Desert Aire, Technical Bulletin 18, Natatorium Economizer Vs. Conventional Dehumidifier, 121 Oct. 1999, pp. 1-6.
Moustafa M. Elsayed, PH.D., Mohammed M. El-Refaee, PH.D., Yousef A. Borhan, Energy-Efficient Heat Recovery Systems for Air Conditioning of Indoor Swimming Pools, Ashrae Transactions: Research, pp. 259-269.
De Champs, Commercial Products, pp. 1-6.
Des Champs, Modular Outside Air Conditioning Systems, MOACS498/5M, pp. 1-15, 1998.
Dry-O-Tron, Residential & Light Commercial Dehumidifiers & Air Conditioners, MAM Series, 2002, pp. 1-4.
Trane, Engineering Bulletin RT-PRB011-EN, Trane Precedent/Voyager Dehumidification (Hot Gas Reheat) Option, Feb. 2004, pp. 1-12.
York International, Unitary Products Group, Installation Manual: Sunline MagnaDRY Gas/Electric Single Package Air Conditioners Models DR180, 240 and 300, 2004, pp. 1-64.

* cited by examiner

METHOD FOR REFRIGERANT PRESSURE CONTROL IN REFRIGERATION SYSTEMS

FIELD OF THE INVENTION

The present invention relates generally to heating, ventilation and air conditioner HVAC systems. In particular, the present invention is related to methods and/or systems that control HVAC system refrigerant pressure.

BACKGROUND OF THE INVENTION

An HVAC system generally includes a closed loop refrigeration system with at least one evaporator, at least one condenser and at least one compressor. As the refrigerant travels through the evaporator, it absorbs heat from a heat transfer fluid to be cooled and changes from a liquid to a vapor phase. After exiting the evaporator, the refrigerant proceeds to a compressor, then a condenser, then an expansion valve, and back to the evaporator, repeating the refrigeration cycle. The fluid to be cooled (e.g. air) passes through the evaporator in a separate fluid channel and is cooled by the evaporation of the refrigerant. The cooled fluid can then be sent to a distribution system for cooling the spaces to be conditioned, or it can be used for other refrigeration purposes.

One type of air conditioner system is a split system where there is an indoor unit or heat exchanger, which is generally the evaporator, and an outdoor unit or heat exchanger, which is generally the condenser. Often, the outdoor unit is placed outdoors and is subject to outdoor ambient conditions, particularly temperature. When the outdoor ambient temperature falls, the amount of heat being removed from the refrigerant in the condenser increases. The increased heat removal in the condenser can result in a decrease in the refrigerant pressure at the suction line to the compressor, commonly referred to as head pressure. The decrease in head pressure results in a lowering of the temperature of the refrigerant at the evaporator. When the temperature of the refrigerant at the evaporator becomes too low, icing of the system can occur. Icing is a condition when the temperature at the exterior of the evaporator is sufficiently low to freeze water present in the atmosphere. The ice formed by the water frozen on the surface reduces the available heat transfer surface and eventually prevents the proper operation of the HVAC system by inhibiting heat transfer and/or damaging system components.

Some attempts to address the problem of icing have utilized the control of system pressure. In one approach, a variable speed condenser fan or a plurality of condenser fans having independent controls are used to control airflow over the condenser coil. As the amount of air passing over the coil decreases, the amount of heat transfer taking place at the coil decreases. Therefore, the temperature of the refrigerant in the condenser and the pressure of the system increase to allow the indoor coil to cool the air without icing problems. The use of the variable speed condenser fan or a plurality of condenser fans having independent controls has the drawback that it is expensive and requires complicated wiring and controls.

An alternate approach for the problem of low system pressure or icing is a parallel set of condensers in the refrigerant cycle, as described in U.S. Pat. No. 3,631,686. The parallel set of refrigerant condensers allows for two modes of operation. One mode of operation allows refrigerant to flow from only one of the refrigerant condensers. During this mode of operation, the condenser that does not permit the flow of refrigerant fills with liquid refrigerant. Because of this flooding, there is a reduction in the effective surface area of the condenser. The reduced surface area thereby reduces the ability of the condenser to remove heat from the refrigerant. Therefore, the temperature of the refrigerant in the condenser and the head pressure of the system increase allowing the indoor coil to cool the air without icing. The use of parallel refrigerant condensers has the drawback that it requires an additional condenser coil and additional piping, thereby increasing the space and cost required for installation. Another drawback associated with refrigerant flooding of the condenser coil is the resultant decrease in system capacity. Refrigerant normally available in a properly operating system is trapped in the condenser coil and not available to the compressor, thereby decreasing system capacity.

An additional alternate approach for the problem of low system pressure is the use of a valve that controls the discharge or flow of liquid refrigerant from the condenser to a receiver vessel downstream of the condenser to maintain control of the amount of condensing surface exposed to the outside temperature, as described in U.S. Pat. No. 2,874,550. The discharge of refrigerant from the condenser is controlled by a pressure-response valve that mechanically opens to allow the flow of liquid refrigerant from the condenser to the receiver vessel reducing the level of liquid inside the condenser, thereby lowering the system pressure. Alternatively, the valve is closed to stop the flow until the level of refrigerant rises in the condenser in an amount that reduces the effective cooling surface of the condenser. The reduced surface area thereby reduces the ability of the condenser to remove heat from the refrigerant, thereby raising the pressure of the system. The use of a pressure-response valve and a vessel downstream of the condenser to maintain control of the amount of condensing surface has the drawback that it includes a specially designed valve and additional piping, thereby increasing the required space and cost. As discussed above, another one of the drawbacks with refrigerant flooding the condenser coil is decreased system capacity. Refrigerant normally available in a properly operating system is trapped in the condenser coil and not available to the compressor, thereby decreasing system capacity.

An additional alternate approach for the problem of low system pressure is the use of a refrigerant bypass around the condenser, as described in U.S. Pat. No. 3,060,699 and U.S. Reissued Pat. No. Re. 27,522. If the temperature and pressure of the refrigerant in the condenser are sufficiently high, a valve will close on a condenser bypass and the flow of refrigerant will be directed to the condenser. If the temperature and pressure of the condenser are not sufficiently high, the valve will open on a condenser bypass and at least some of the flow of refrigerant will be directed away from the condenser. The result of the bypass is an increase in pressure through the pipe leading to the evaporator downstream of the compressor. The use of a bypass has the drawback that it includes a specially designed valve and additional piping, thereby increasing the required space and cost.

What is needed is a method and system for controlling the system refrigerant pressure without the drawbacks discussed above.

SUMMARY OF THE INVENTION

The present invention includes a method for controlling refrigerant pressure in an HVAC system. The method includes providing a compressor, a condenser and an evaporator connected in a closed refrigerant loop. The condenser has a header arrangement capable of distributing refrigerant to a plurality of refrigerant circuits within the condenser. The header arrangement also is capable of selectively isolating at least one of the refrigerant circuits from refrigerant flow.

Refrigerant pressure is sensed at a predetermined location in the refrigeration system. At least one of the refrigerant circuits is isolated when the refrigerant pressure is less than or equal to a predetermined pressure.

The present invention also includes a method for controlling refrigerant pressure in an HVAC system. The method includes providing a closed loop refrigerant system comprising a compressor, a condenser and an evaporator. The condenser has a header arrangement capable of distributing refrigerant to a plurality of circuits within the condenser. The header arrangement is also capable of selectively isolating at least one of the circuits from refrigerant flow. Refrigerant pressure is measured at a predetermined location in the refrigeration system. At least one of the circuits is isolated from refrigerant flow when the measured pressure is equal to or less than a predetermined pressure. The number of circuits isolated within the condenser varies with the measured pressure with respect to the predetermined pressure. The isolation of the refrigerant circuits continues until the measured pressure is greater than the predetermined pressure.

The present invention also includes a heating, ventilation and air conditioning system. The HVAC system includes a refrigerant system having a compressor, an evaporator, and a condenser connected in a closed refrigerant loop. The HVAC system also includes a refrigerant pressure measuring device for sensing refrigerant pressure disposed at a predetermined location within the refrigerant system. The condenser includes a plurality of refrigerant circuits, a first valve arrangement and a second valve arrangement. The first valve arrangement is arranged and disposed to isolate one or more of the refrigerant circuits from flow of refrigerant when the refrigerant pressure is below a predetermined pressure. The second valve arrangement is arranged and disposed to draw refrigerant into or out of the isolated circuits of the condenser in response to the refrigerant pressure sensed by the refrigerant pressure measuring device.

The present invention provides an inexpensive method and system to control head pressure. The method and system requires little or no additional piping in order to implement the method and system. The system requires less in materials and therefore costs less. Additionally, the method and system of the present invention does not require the use of variable speed or multiple stage fans to control air flow across the heat exchangers of the HVAC system.

The lack of additional piping also allows retrofitting of the system into existing HVAC systems. Because, little or no additional piping is required, the system occupies approximately the same volume as existing HVAC systems. Therefore, the method and system of the present invention may be used in existing systems whose piping has been arranged according to the present invention or as a new system.

Another advantage of the present invention is that the air conditioning or heat pump unit can operate at lower ambient temperatures. The method and system of the present invention provides an increase in system pressure, thereby allowing the system to operate at lower ambient temperatures without icing of the system components.

Other features and advantages of the present invention will be apparent from the following more detailed description of the preferred embodiment, taken in conjunction with the accompanying drawings which illustrate, by way of example, the principles of the invention.

BRIEF DESCRIPTION OF THE DRAWINGS

Wherever possible, the same reference numbers will be used throughout the drawings to refer to the same or like parts.

DETAILED DESCRIPTION OF THE INVENTION

Figure 1:
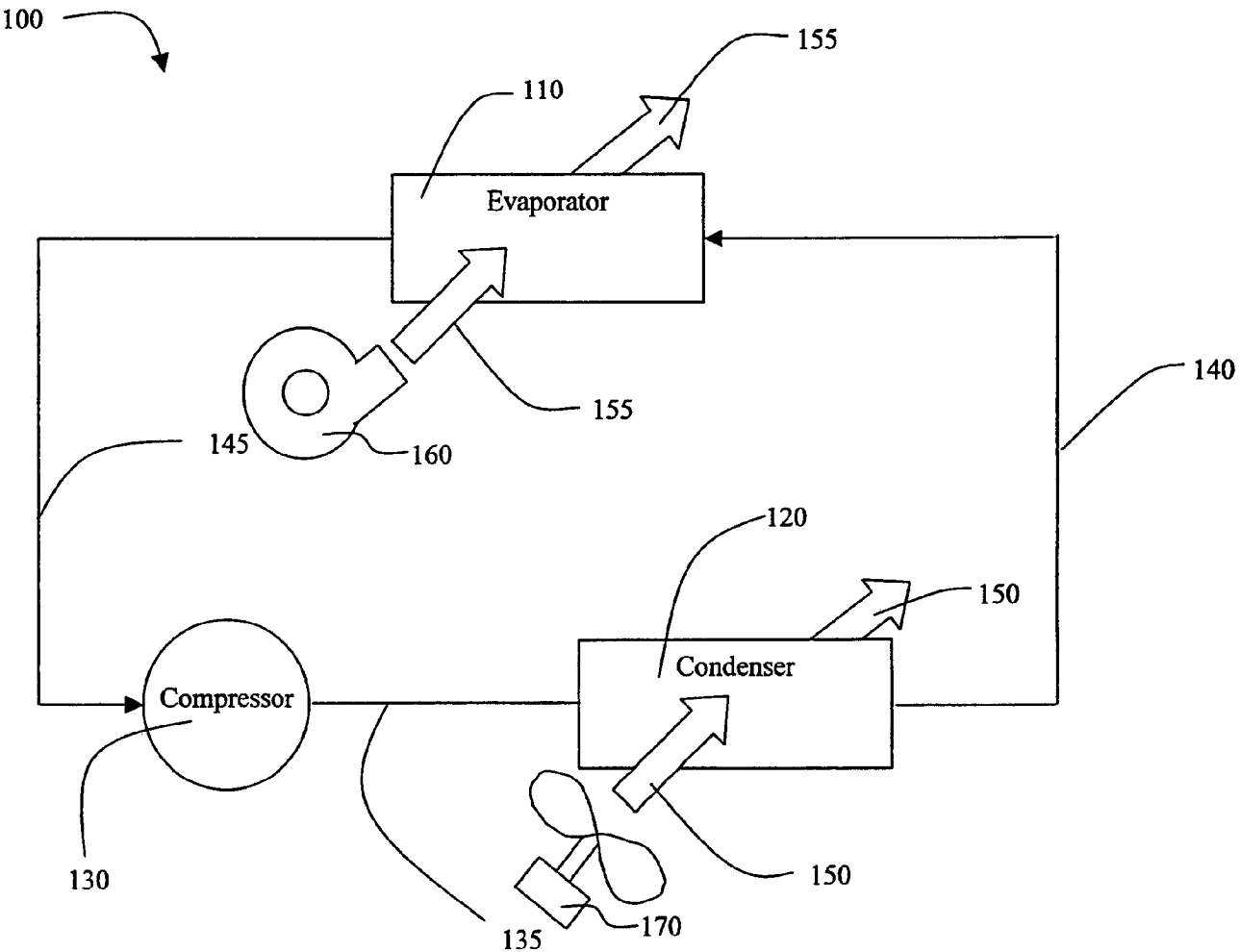
FIG. 1 illustrates schematically a refrigeration system.

FIG. 1 illustrates an HVAC, refrigeration, or chiller system 100. Refrigeration system 100 includes a compressor 130, a condenser 120, and an evaporator 110. The compressor 130 compresses a refrigerant vapor and delivers it to the condenser 120 through compressor discharge line 135. The compressor 130 is preferably a reciprocating or scroll compressor, however, any other suitable type of compressor can be used, for example, screw compressor, rotary compressor, and centrifugal compressor. The refrigerant vapor delivered by the compressor 130 to the condenser 120 enters into a heat exchange relationship with a first heat transfer fluid 150 and undergoes a phase change to a refrigerant liquid as a result of the heat exchange relationship with the fluid 150. Suitable fluids for use as the first heat transfer fluid 150 include, but are not limited to, air and water. The first heat transfer fluid 150 is moved by use of a fan 170, which moves the first heat transfer fluid 150 through the condenser 120 in a direction perpendicular the cross section of the condenser 120. In a preferred embodiment, the refrigerant vapor delivered to the condenser 120 enters into a heat exchange relationship with air as the first heat transfer fluid 150. The refrigerant leaves the condenser through the condenser discharge line 140 and is delivered to an evaporator 110 after passing through an expansion device (not shown). The evaporator 110 includes a heat-exchanger coil. The liquid refrigerant in the evaporator 110 enters into a heat exchange relationship with a second heat transfer fluid 155 to lower the temperature of the second heat transfer fluid. Suitable fluids for use as the second heat transfer fluid 155 include, but are not limited to, air and water. The second heat transfer fluid 155, preferably air, is moved by use of a blower 160, which moves the second heat transfer fluid 155 through evaporator 110 in a direction perpendicular the cross section of the evaporator 110. Although FIG. 1 depicts the use of a blower 160 and fan 170, any fluid moving means may be used to move fluid through the evaporator and condenser. In a preferred embodiment, the refrigerant vapor delivered to the evaporator 110 enters into a heat exchange relationship with air as the second heat transfer fluid 155. The refrigerant liquid in the evaporator 110 undergoes a phase change to a refrigerant vapor as a result of the heat exchange relationship with the second heat transfer fluid 155. The vapor refrigerant in the evaporator 110 exits the evaporator 110 and returns to the compressor 130 through a suction line 145 to complete the cycle. It is to be understood that any suitable configuration of evaporator 110 can be used in the system 100, provided that, the appropriate phase change of the refrigerant in the evaporator 110 is obtained. The conventional refrigerant system includes many other features that are not shown in FIG. 1. These features have been purposely omitted to simplify the figure for ease of illustration.

Figure 2:
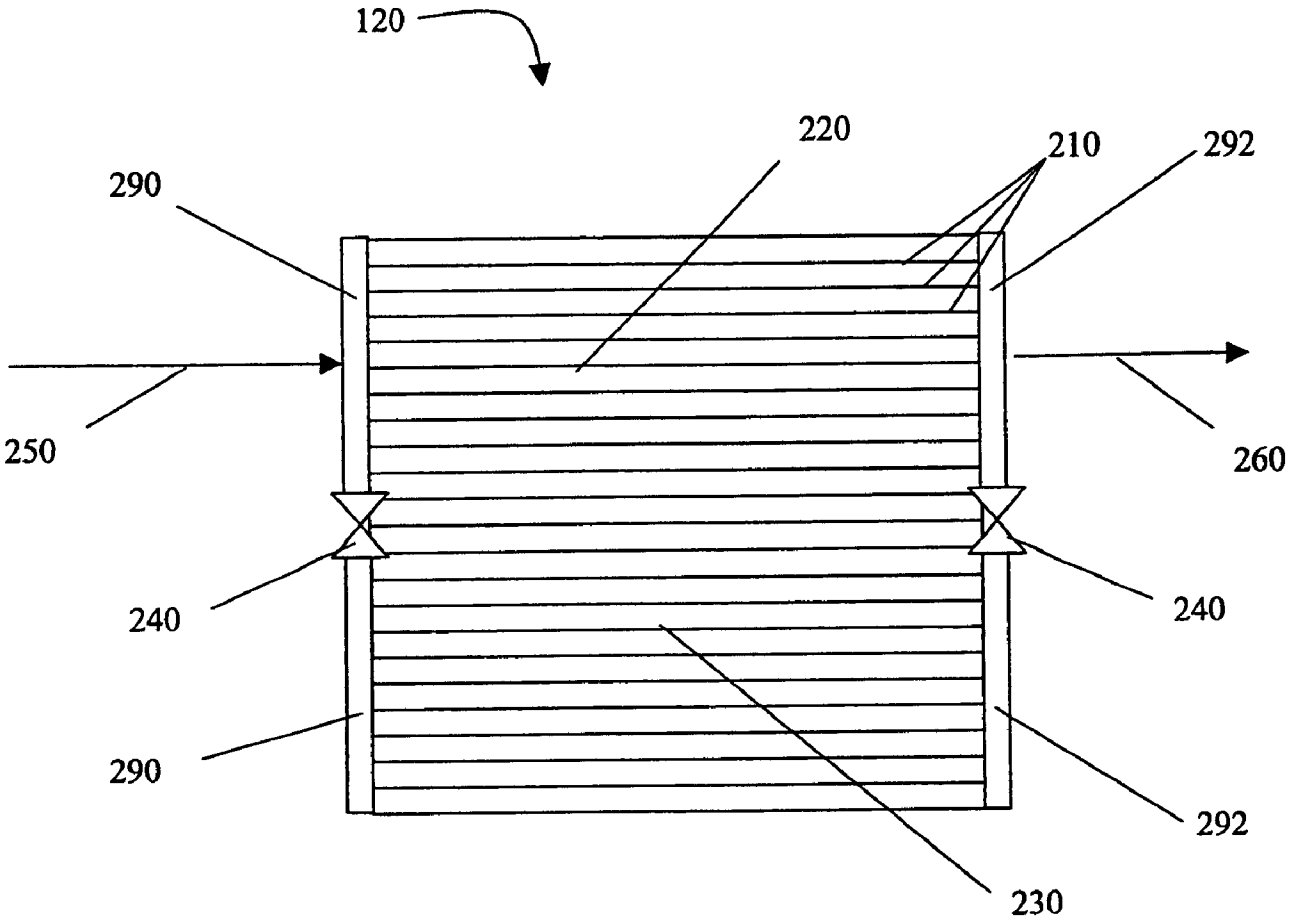
FIG. 2 illustrates schematically a condenser piping arrangement in one embodiment where the isolation valves are positioned inside the header.

FIG. 2 illustrates a condenser 120 according to one embodiment of the invention. Condenser 120 includes a plurality of heat transfer circuits 210. The heat transfer circuits 210 are preferably partitioned into a first condenser portion 220 and a second condenser portion 230. The first and second condenser portions 220 and 230 may be sized in any proportion. For example, the first condenser portion 220 may be 60% of the size of the condenser 120 and the second condenser portion 230 may be 40% of the size of the condenser 120 or the first condenser portion 220 may be 40% of the size of the condenser 120 and the second condenser portion 230 may be 60% of the size of the condenser 120 or the first and second condenser portions 220 and 230 may each represent 50% of the size of the condenser 120. When the first and second condenser portions 220 and 230 are different sizes, e.g., 60%/40% split, the refrigerant flow may be directed in any manner that provides efficient condenser 120 operation. For example, the first condenser portion 220 may constitute 60% of the size of the condenser 120 and the second condenser portion 230 may constitute 40% of the condenser 120. When desirable, the flow may be directed to either the 60% portion or the 40% portion and the designation of the first and second condenser portions 220 and 230 may be alternated to the isolated portion that provides the desired condenser 120 operation.

In addition to the various ratios of the first condenser portion 220 to the second condenser portion 230, the locations along the face of the condenser, perpendicular to the air, of the first and second condenser portions 220 and 230 may be selected to provide a greater efficiency in heat transfer when a condenser portion is isolated. In one embodiment, the first condenser portion 220 is arranged and disposed to isolate heat transfer circuits 210 that are positioned along the face of the condenser 120 in locations having a decreased overall heat transfer efficiency. Suitable locations for the isolated first condenser portion 220 in this embodiment include the heat transfer circuits 210 at the edges of the condenser, where the flow of heat transfer fluid is lower. The heat transfer circuits 210 on the outer edges of the condenser 120 typically receive less heat transfer fluid flow and have a lower heat transfer efficiency. Isolating the heat transfer circuits 210 having a lower efficiency and allowing the flow of refrigerant in heat transfer circuits 210 having a higher efficiency, such as the heat transfer circuits 210 near the center of the condenser 210, permits the condenser 120 to operate at a higher overall efficiency, while controlling the head pressure of the system. The isolation of the heat transfer circuits 210 may take place with each of the condenser portions in a single continuous area along the face of the condenser, or may be discontinuous, such that the heat transfer circuits of a single condenser portion may be split into two or more sections to provide increased heat transfer efficiency for the condenser 120. In this embodiment, the first condenser portion 220 may be arranged and disposed along the face of the condenser such that the less efficient heat transferring edge portions may be isolated in discontinuous portions of the face of the condenser, leaving a continuous second condenser portion in the more efficient heat transferring center portion of the condenser 120.

As shown in FIG. 2, inlet flow 250 includes vaporous refrigerant from the compressor 130. Inlet flow 250 enters the condenser 120 travels through the heat transfer circuits 210, where the heat transfer circuits 210 can enter into a heat exchange relationship with a heat transfer fluid such as air or water. The condenser 120 preferably has two condenser portions; however, the present invention is not limited to two condenser portions. The present invention may include more than two condenser portions. Where more than two condenser portions are present, the flow may be regulated to each of the portions. For example, in the embodiment where the condenser is split into three portions, two of the three portions include valve arrangements that allow independent isolation of each of these portions. One or both of the two portions with valve arrangements may be isolated, dependent on a signal from a controller and/or sensor. In FIG. 2, isolation valves 240 are positioned in the vapor header 290 and liquid header 292 of the condenser 120. When isolation valves 240 are closed, the refrigerant is prevented from flowing into the second condenser portion 230. When isolation valves 240 are open, refrigerant is permitted to flow to both the first condenser portion 220 and the second condenser portion 230. The outlet flow 260 leaving the condenser comprises liquid refrigerant resulting from the heat exchange relationship with the heat transfer fluid and the resultant phase change. The outlet flow 260 is then circulated to the evaporator 110.

Figure 3:
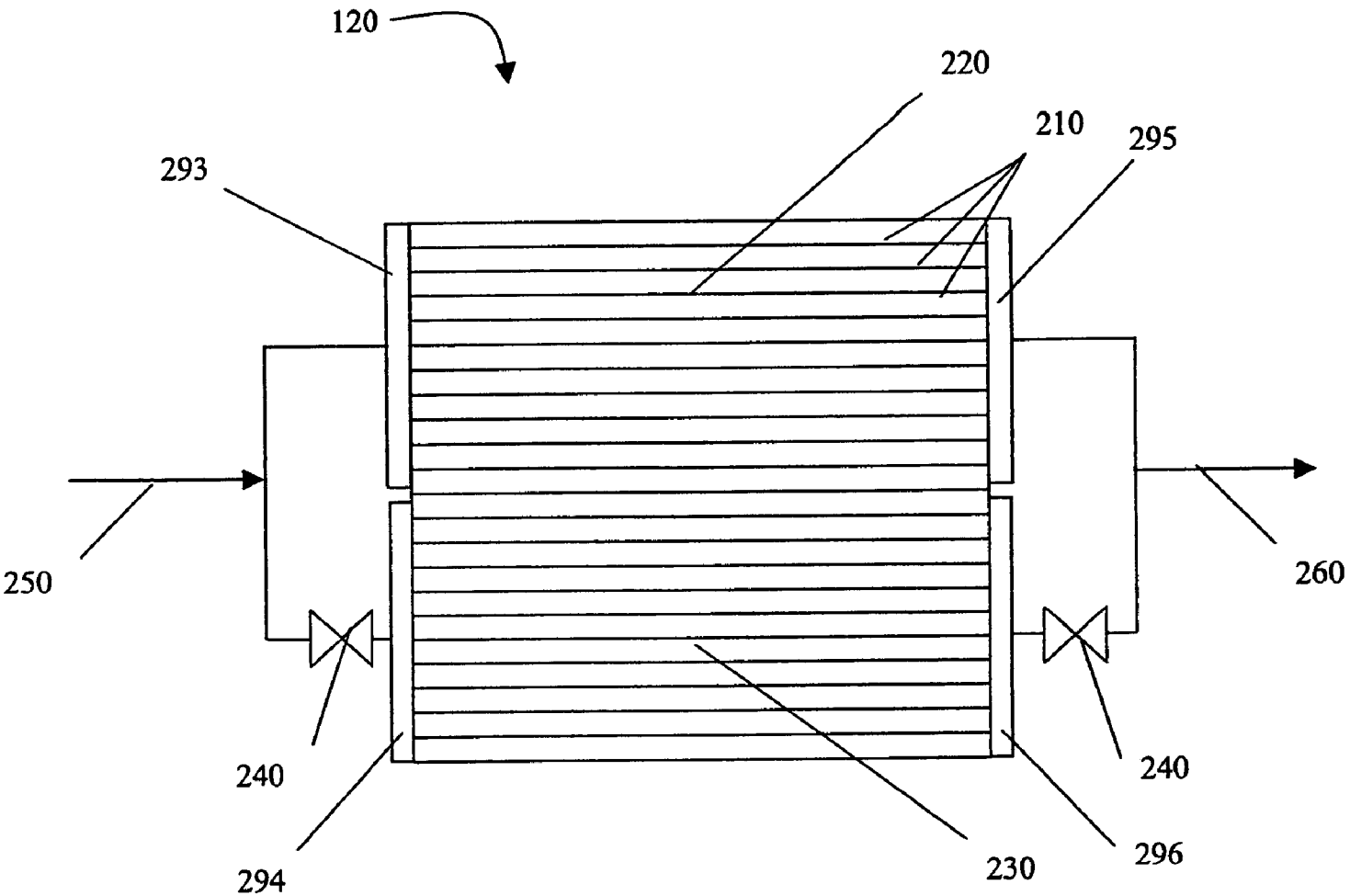
FIG. 3 illustrates schematically a condenser piping arrangement in another embodiment where the isolation valves are positioned on the piping connected to the headers for the individual circuits.

FIG. 3 illustrates a condenser 120 according to alternate embodiment of the invention. Condenser 120 includes a plurality of heat transfer circuits 210. The heat transfer circuits 210 are partitioned into a first condenser portion 220 and a second condenser portion 230. Although FIG. 3 shows two condenser portions, the present invention is not limited to two condenser portions. The present invention may include more than two condenser portions. Inlet flow 250 is vaporous refrigerant from the compressor 130 that is split into two refrigerant streams. The two refrigerant streams enter the condenser 120 through two vapor headers 293 and 294 and travel into the heat transfer circuits 210. Heat transfer circuits 210 can enter into a heat exchange relationship with a heat transfer fluid such as air or water. The two refrigerant streams then exit the condenser 120 through two liquid headers 295 and 296. Isolation valves 240 are positioned on the piping to the vapor header 294 and on the piping from the liquid header 296 of the condenser 120. When isolation valves 240 are closed, the refrigerant is prevented from flowing into the second condenser portion 230. When isolation valves 240 are open refrigerant is permitted to flow to both the first condenser portion 220 and the second condenser portion 230. The outlet flow 260 leaving the condenser 120 includes liquid refrigerant resulting from the heat exchange relationship with the heat transfer fluid and the resultant phase change. The outlet flow 260 is circulated to the evaporator 110.

Figure 4:
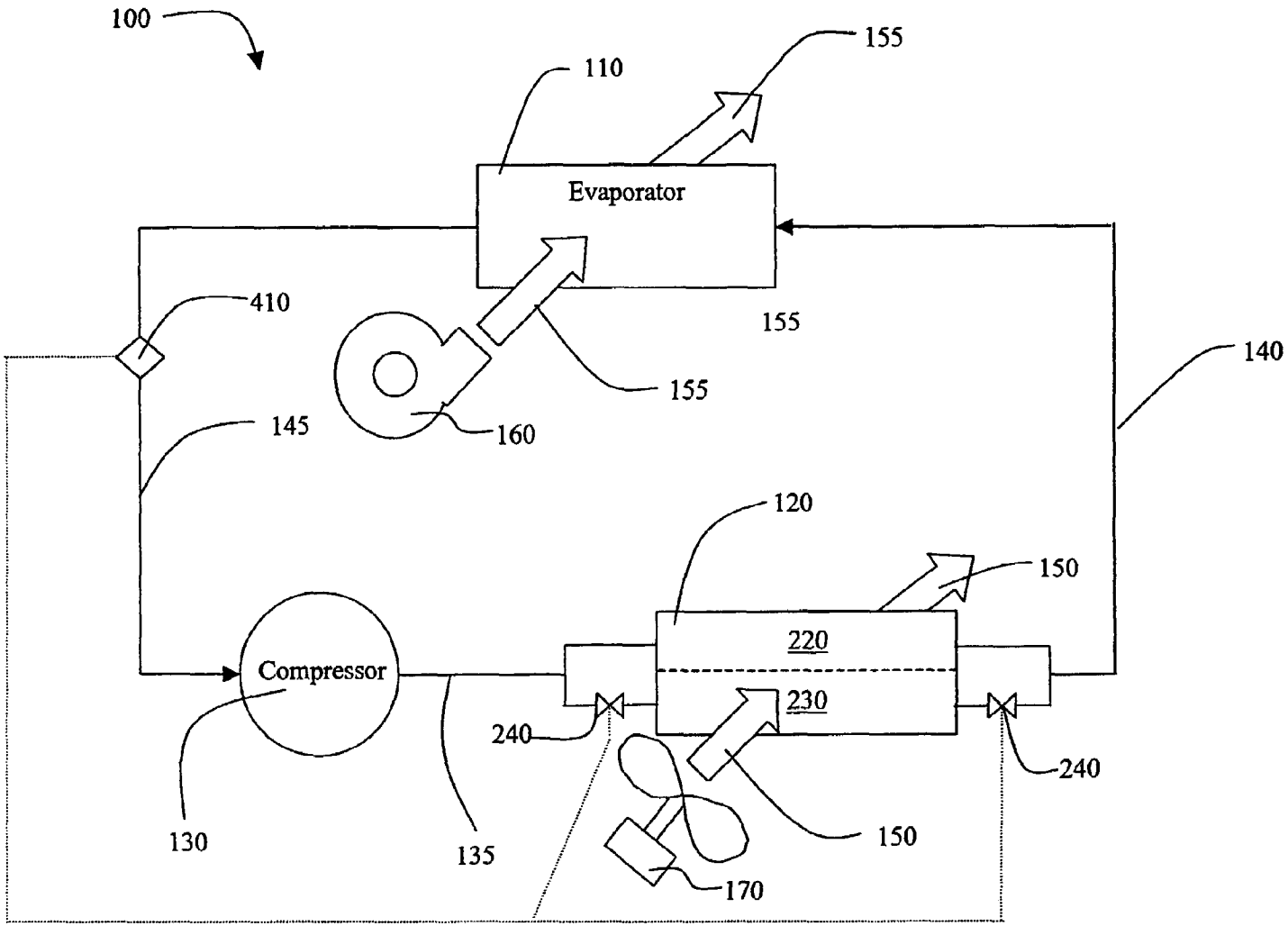
FIG. 4 illustrates schematically a refrigeration system according to another embodiment including a pressure switch for controlling the isolation valves.

FIG. 4 illustrates a refrigeration system 100 according to an alternate embodiment of the present invention. The refrigeration system 100 includes a compressor 130, a condenser 120, and an evaporator 110. The condenser 120 is a partitioned condenser having two partitions, shown as the first and second condenser portions 220 and 230. Although FIG. 4 shows two condenser portions, the present invention is not limited to two condenser portions. The present invention may include more than two condenser portions. The piping to the condenser 120 includes isolation valves 240 on the inlet side and the outlet side of the second condenser portion 230 inside the condenser 120. Closing the isolation valves 240 prevents the flow of refrigerant to the second condenser portion 230. The isolation valves are controlled by a pressure switch 410 that senses pressure on the refrigerant line from the evaporator 110 to the compressor 130. When the pressure on the compressor suction line 145 from the evaporator 110 to the compressor 130 reaches a predetermined level, the isolation valves 240 can be closed to the second condenser portion 230. For example, the predetermined pressure may include a pressure of from about 160 to about 200 psi, preferably about 180 psi. However, the predetermined pressure is not limited to about 180 psi. and may be any suitable minimum pressure for the system. In particular, the suitable minimum pressure may be a minimum pressure utilized for a particular type of compressor 130 present in the system. Once isolation valves 240 are closed, the refrigerant is only permitted to flow through the first condenser portion 220. Because the refrigerant is only permitted to flow into first condenser portion 220, the heat transfer area and the corresponding amount of heat transfer occurring in the condenser 120 is reduced. Therefore, less heat is removed from the refrigerant. Likewise, less heat is transferred to the first transfer fluid 150, thereby maintaining a higher refrigerant temperature. Additionally, because the temperature of the refrigerant is higher, the corresponding pressure of the refrigerant is also higher. Therefore, the refrigerant pressure of the system is increased.

Figure 5:
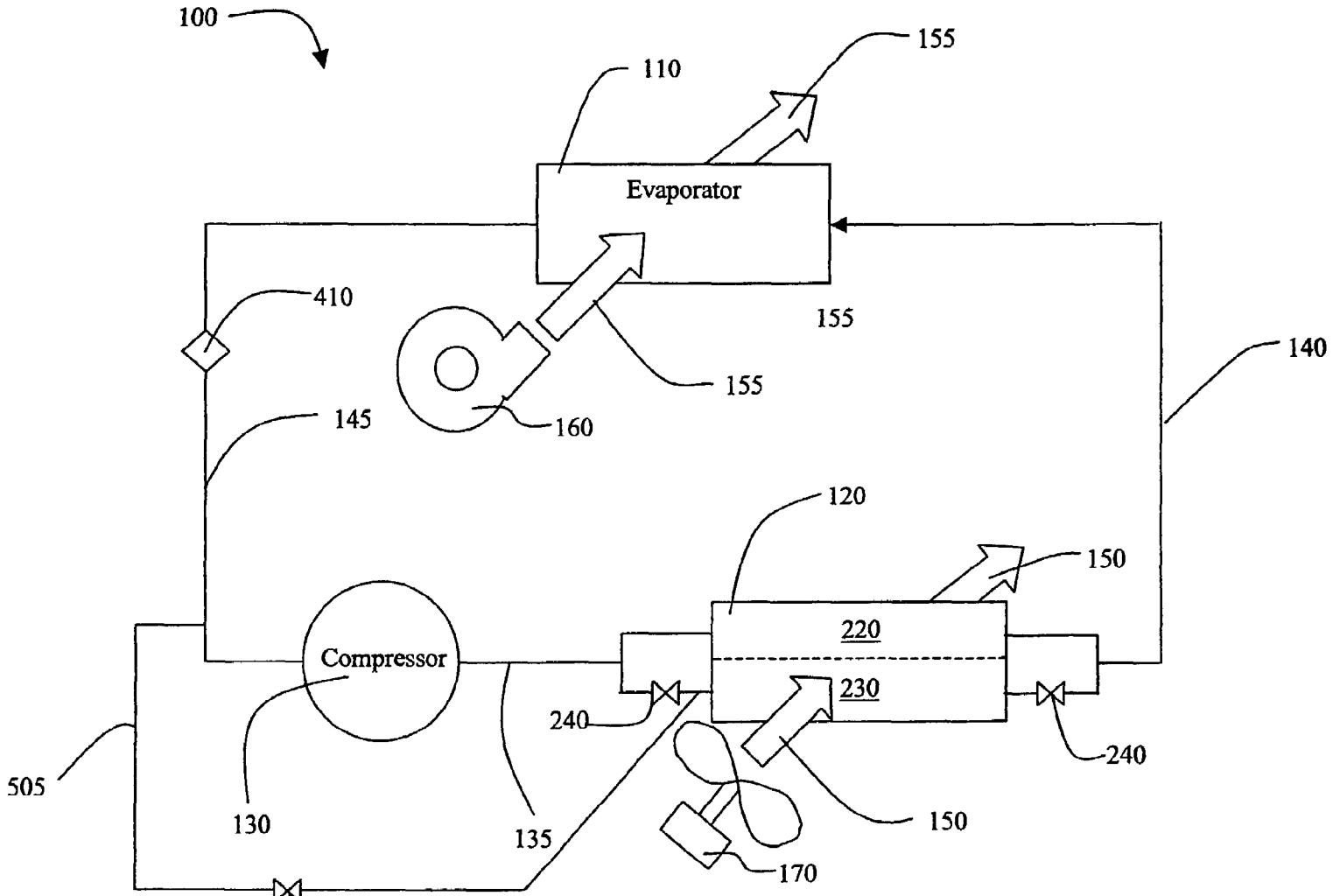
FIG. 5 illustrates schematically a refrigeration system according to another embodiment including a drain line for the isolated portion of the condenser.

FIG. 5 shows an alternate embodiment according to the invention. FIG. 5 has substantially, the same piping arrangement as FIG. 4. FIG. 5 further includes a drain line 505 and a drain valve 510. The refrigerant remaining in the second condenser portion 230 after isolation valves 240 are closed may be stored in the second condenser portion 230 or may be drawn into the refrigeration system 100. Drain line 505 connects condenser portion 230 with the suction line of the compressor. Opening drain valve 510 allows the refrigerant to be drawn from the isolated portion of the condenser into the active system. Drawing refrigerant into the refrigeration system provides additional refrigerant per unit volume of the system, thereby further increasing the refrigerant pressure. Alternatively, refrigerant may also be drawn out of the active portion of the refrigerant system 100 to reduce the pressure of the refrigerant, when a reduced refrigerant pressure is desirable.

Figure 6:
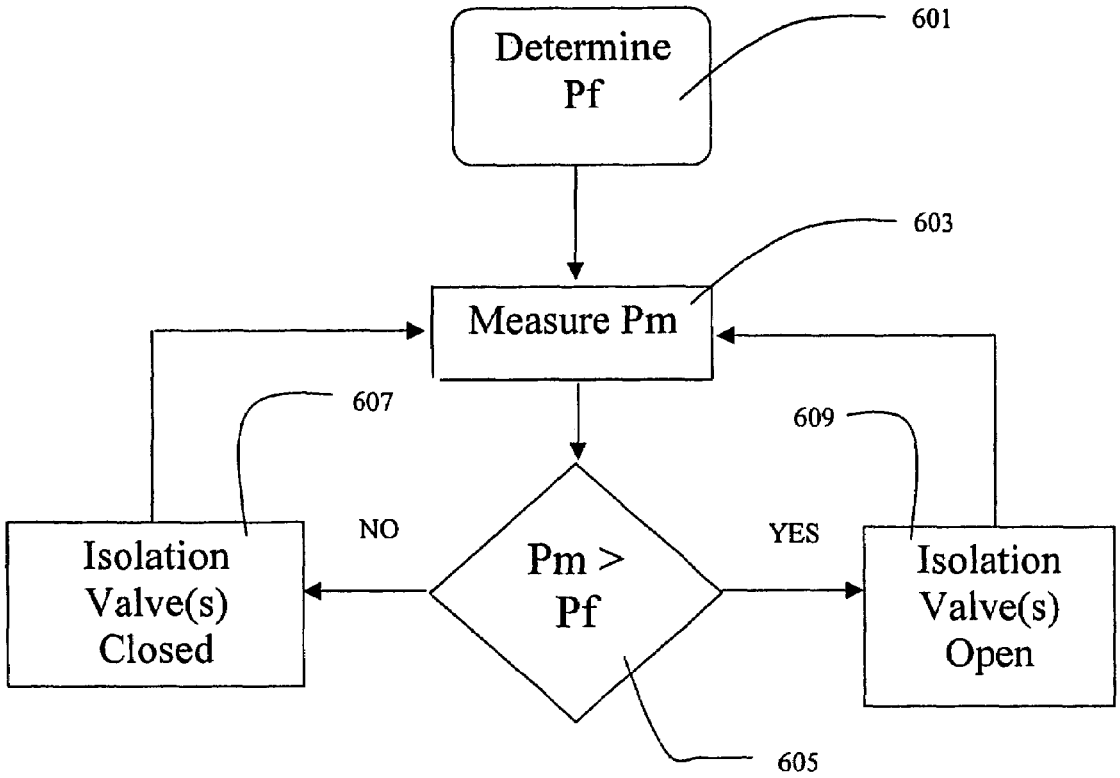
FIG. 6 illustrates a control method according to one embodiment of the present invention.

FIG. 6 illustrates a flow chart detailing a method of the present invention relating to head pressure control in a HVAC system. The method includes a determination of the minimum system head pressure, Pf, at step 601. The minimum head pressure is set to the desired operating pressure of the refrigeration system 100. The minimum head pressure is preferably greater than the pressure corresponding to temperature of evaporator icing. Evaporator icing occurs at refrigerant evaporation temperatures of about 25.degree. F. to about 32.degree. F. The actual refrigerant temperature corresponding to frost build up will depend on numerous heat transfer factors specific to a given coil. Pf is preferably the refrigerant pressure that corresponds to greater than about 27.degree. F. A suitable minimum system head pressure includes, but is not limited to about 180 psig. Subsequent to determining the minimum system head pressure, Pf, the actual system head pressure, Pm, is measured at step 603. Any pressure measurement method is suitable for determining Pm. Preferably, the measurement takes place at or near the outlet of the evaporator. Subsequent to the measurement taken at step 603, a determination of whether the pressure of the refrigerant measured is below the pressure corresponding to minimum system head pressure, Pf, at step 605. If the measured pressure of the refrigerant, Pm, is below the pressure for evaporator freezing, which correspond to Pf, (i.e. "NO" on the flowchart show in FIG. 6), isolation valve(s) 240 are closed and refrigerant flow is blocked to one or more of the refrigerant circuits inside of the condenser 120 in step 507. If the measured pressure of the refrigerant, Pm, is not below the minimum system head pressure, Pf, (i.e. "YES" on the flowchart shown in FIG. 6), isolation valves 240 either opened, if previously closed, or remain open, if previously open. The opening of the valves 240 in step 609 allows refrigerant to flow to all refrigerant circuits within the condenser. When the refrigerant flows through all the circuits 210 of the condenser the heat transfer to the first heat transfer fluid 150 from the refrigerant is at a maximum. If the isolation valves 240 are closed in step 607, the refrigerant is only permitted to flow through a portion of the condenser 120. Each portion has a predetermined heat transfer surface area. Because the refrigerant is only permitted to flow into a portion of the condenser and some portions are isolated, the heat transfer area and the corresponding amount of heat transfer is reduced. Therefore, less heat is removed from the refrigerant. Likewise, less heat is transferred to the first heat transfer fluid 150, thereby maintaining a higher refrigerant temperature. Additionally, because the temperature of the refrigerant is higher, the corresponding pressure of the refrigerant is also higher. Therefore, the refrigerant pressure of the system is increased.

Figure 7:
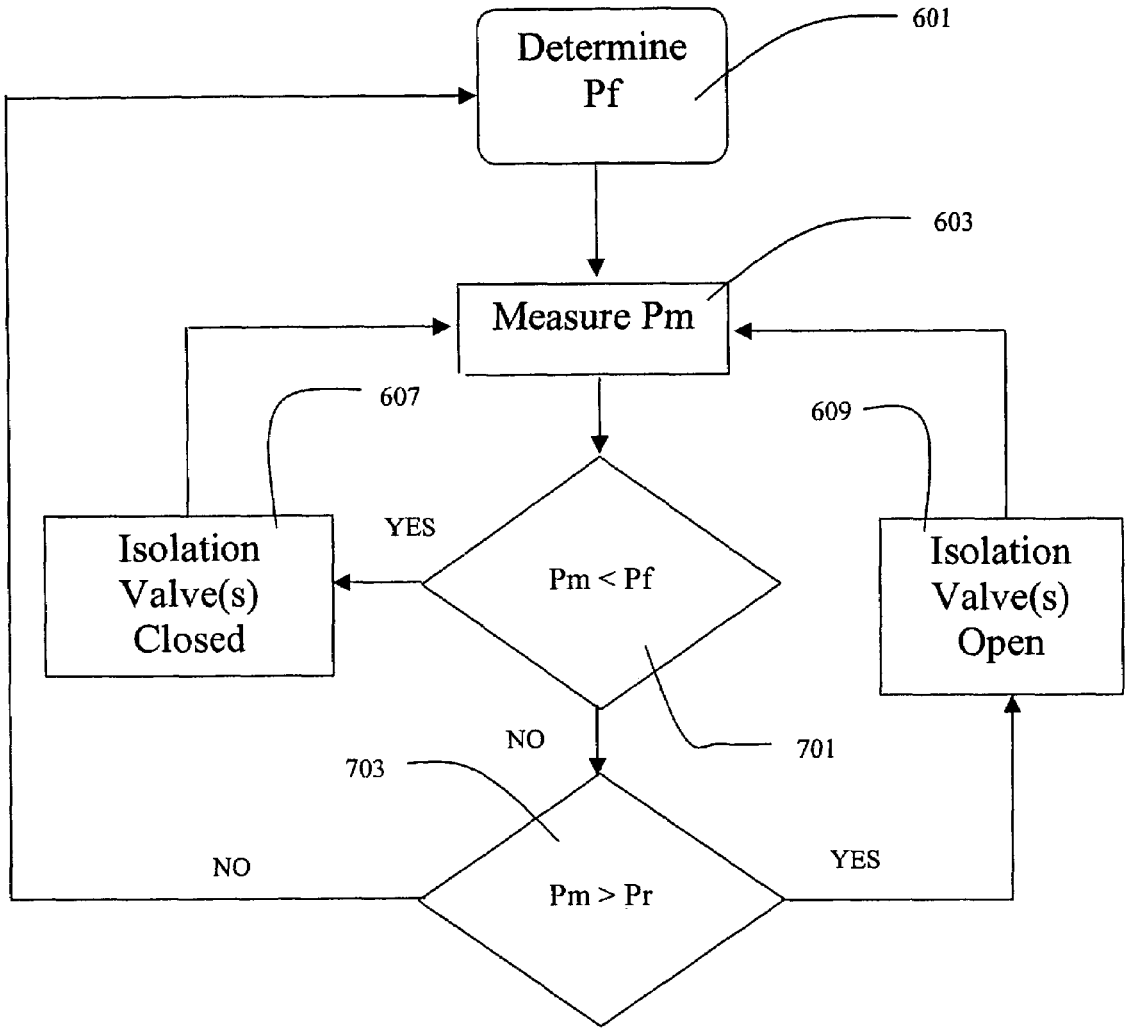
FIG. 7 illustrates an alternate control method according to one embodiment of the present invention.

FIG. 7 shows an alternate method according to the present invention with a refrigerant pressure reset to provide less cycling of the isolation valve(s) 240. The method includes the determination step 601, the measuring step 603, the valve operation systems 607 and 609, as shown as described with respect to FIG. 6. However, FIG. 7 includes a reset determination step 703. In the method describe in FIG. 7, subsequent to the measurement taken at step 603, a determination of whether the measured refrigerant pressure is less than the minimum system head pressure, Pf, is made at step 701. If the measured pressure of the refrigerant, Pm, is less than the pressure for evaporator freezing, which corresponds to Pf, (i.e., "YES" on the flowchart show in FIG. 7), isolation valve(s) 240 are closed and refrigerant flow is blocked to one or more of the refrigerant circuits inside of the condenser 120 in step 607. If the measured pressure of the refrigerant, Pm, is greater than the minimum system head pressure, Pf, (i.e., "NO" on the flowchart shown in FIG. 7), a determination of whether the measure head pressure, Pm, is less than the system reset pressure, Pr as shown in step 703. If the measured pressure, Pm, is greater than the system reset Pressure, Pr, (i.e., "YES" on the flowchart shown in FIG. 7), the isolation valves 240, if closed, will be opened. If the measured pressure, Pm, is less than the system reset pressure, Pr, (i.e. "NO" on the flowchart shown in FIG. 7), then no action will be taken regarding the isolation valves 240. If open, the isolation valves 240 will remain open. If closed, the isolation valves 240 will remain closed. The value Pr-Pf represents a pressure buffer for the system so that the isolation valves 240 will not be inclined to open and close rapidly. The opening of the isolation valves 240 in step 609 allows refrigerant to flow to all refrigerant circuits within the condenser.

In the HVAC system according to the present invention, when the pressure in the suction line 145 to the compressor 130 falls, the temperature of the refrigerant in the evaporator 110 likewise falls. When the pressure falls to a certain level, the evaporator 110 operates at temperatures that may result in icing of the evaporator 110. Icing is a condition when the temperature at the exterior of the evaporator is sufficiently low to freeze water present in the heat transfer fluid. In particular, in a residential system, the heat transfer fluid is typically air and the water that freezes is water present in the air in the form of humidity. The ice formed by the water frozen on the surface eventually prevents the proper operation of the HVAC system by inhibiting heat transfer and/or damaging system components. This icing generally begins at temperatures of from about 25° F. to about 32° F. In order to prevent the freezing of the evaporator, the pressure in the suction line 145 is preferably maintained above the temperature that corresponds to the freezing point of the evaporator 110.

The method and system for controlling the refrigerant pressure of an air conditioning or heat pump unit according to the present invention includes an HVAC unit that can operate at lower ambient temperatures. The present invention involves a piping arrangement that partitions the circuits within the condenser of a refrigeration system. The piping arrangement includes valves positioned so that one or more of the circuits within the condenser may be isolated from flow of refrigerant. The piping arrangement may be applied to a new system or may be applied an existing system. Applying the piping arrangement to the existing system has the advantage that it allows control of the refrigerant pressure without the addition of expensive piping, equipment and/or controls.

When the temperature around the condenser coil falls (e.g. when the outdoor temperature falls), the system refrigerant pressure falls proportionally. To help build head pressure, the present invention uses the valves connected to the circuits of the condenser to isolate a portion of the condenser from flow of refrigerant. The portion of the condenser that is not isolated remains in the active circuit and receives refrigerant. Because the refrigerant is only permitted to flow into a portion of the condenser 120, the heat transfer area and the corresponding amount of heat transfer is reduced. Therefore, less heat is removed from the refrigerant. Likewise, less heat is transferred to the first heat transfer fluid 150, thereby maintaining a higher refrigerant temperature. Additionally, because the temperature of the refrigerant is higher, the corresponding pressure of the refrigerant is also higher. Therefore, the refrigerant pressure of the system is increased.

In one method according to the invention, the pressure of the refrigerant is measured and compared to a predetermined pressure. The pressure measurement may be taken from any point in the system. However, the preferred point of measurement of refrigerant pressure is on the suction line 145 to the compressor. The suction line 145 to the compressor also corresponds to the outlet of the evaporator 110. The outlet of the evaporator 110 represents a low pressure point in the system, due the phase change of the refrigerant to a vapor resulting from the heat exchange relationship existing between the refrigerant and the second heat transfer fluid 155 in the evaporator 110. The lowest pressure point where liquid refrigerant is undergoing evaporation also corresponds to the lowest temperature in the system. The predetermined pressure is preferably a pressure that is greater than or equal to the pressure that corresponds to a temperature that results in icing at the evaporator 110.

The piping arrangement of the condenser 120 of the present invention includes piping sufficient to isolate the two or more heat transfer circuits 210 within the condenser. In one embodiment, the isolation valves 240 are positioned inside the vapor header 290 of the condenser 120. In an alternate embodiment, the isolation valves 240 are positioned on piping upstream from the vapor headers 290 of the condenser 120.

In an alternate embodiment according to the invention, refrigerant stored in the isolated portion of the condenser 120 after isolation valves 240 are closed may be drawn out of the isolated portion of the condenser 120 into the active system by suction pressure. Because the refrigerant from the isolated portion of the condenser adds to the amount of refrigerant per unit volume of the refrigeration system 100 not isolated, the pressure of the refrigerant is increased. Therefore, this addition of refrigerant into the system from the isolated portion of the condenser further assists in raising the system pressure. Alternatively, refrigerant may also be drawn out of the active portion of the refrigerant system 100 to reduce the pressure of the refrigerant, when a reduced refrigerant pressure is desirable. Drawing refrigerant out of the isolated portion of the coil provides additional control of the refrigerant pressure that provides a decrease in refrigerant pressure, particularly during times of unexpected, temporary or small refrigerant pressure increases. For example, the isolated condenser portion may not be opened during a particular pressure increase and the refrigerant may be drawn into the system. This operating condition may be desirable during times such as when the system is subject to gusting wind, changes in sunlight intensity or other temporary change in ambient conditions.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A method for controlling refrigerant pressure in an HVAC system comprising the steps of:

providing a compressor, a condenser and an evaporator connected in a closed refrigerant loop, the condenser having a header arrangement capable of distributing refrigerant to a plurality of refrigerant circuits within the condenser and capable of selectively isolating at least one of the circuits from refrigerant flow;

providing at least one valve arrangement capable of controlling refrigerant flow into and out of at least one of the circuits that can be selectively isolated from refrigerant flow;

sensing refrigerant pressure at a predetermined location in the refrigeration system;

isolating at least one of the refrigerant circuits, in response to the sensed refrigerant pressure;

selectively drawing refrigerant from the at least one refrigerant circuit isolated from refrigerant flow into the refrigerant loop to increase the refrigerant pressure in the refrigerant loop; and selectively drawing refrigerant into the at least one refrigerant circuit isolated from refrigerant flow from the refrigerant loop to decrease the refrigerant pressure in the refrigerant loop.

2. The method of claim 1, wherein the step of isolating at least one refrigerant circuit includes the step of increasing refrigerant pressure by reducing an amount of heat transfer and a refrigerant temperature in the condenser.

3. The method of claim 1, wherein the at least one refrigerant circuit isolated from refrigerant flow is arranged and disposed in locations across a surface of the condenser that receive a reduced flow of heat transfer fluid during operation.

4. The method of claim 3, wherein the at least one refrigerant circuit isolated from refrigerant flow is arranged and disposed at locations at or near edges of the surface of the condenser.

5. The method of claim 1, wherein the isolating includes isolating in response to the sensed refrigerant pressure being less than or equal to a predetermined pressure and wherein the predetermined pressure corresponds to a pressure resulting in icing of the evaporator.

6. A method for controlling refrigerant pressure in an HVAC system comprising:

providing a closed loop refrigerant system comprising a compressor, a condenser and an evaporator, the condenser having a header arrangement capable of distributing refrigerant to a plurality of refrigerant circuits within the condenser and capable of selectively isolating at least one of the circuits from refrigerant flow;

providing at least one valve arrangement capable of controlling refrigerant flow into and out of at least one of the circuits that can be selectively isolated from refrigerant flow;

measuring refrigerant pressure at a predetermined location in the refrigeration system;

isolating at least one of the circuits from refrigerant flow, in response to the measured refrigerant pressure;

selectively drawing refrigerant from the at least one refrigerant circuit isolated from refrigerant flow into the refrigerant system to increase the refrigerant pressure in the refrigerant system;

selectively drawing refrigerant into the at least one refrigerant circuit isolated from refrigerant flow from the refrigerant system to decrease the refrigerant pressure in the refrigerant system; and repeating the steps of measuring and isolating until the measured refrigerant pressure is sufficiently adjusted with respect to the predetermined pressure.

7. The method of claim 6, wherein the predetermined location is between the outlet of the evaporator and the compressor.

8. The method of claim 7, wherein the predetermined pressure corresponds to a pressure resulting in icing of the evaporator.

9. The method of claim 6, wherein the at least one circuit capable of being selectively isolated from refrigerant flow is fluidly connected to an inlet of the compressor.

10. The method of claim 6, wherein the at least one of the circuits isolated from refrigerant flow is arranged and disposed in locations across a surface of the condenser that receive a reduced flow of heat transfer fluid during operation.

11. The method of claim 10, wherein the at least one circuits isolated from refrigerant flow is arranged and disposed at locations at or near edges of the surface of the condenser.

12. The method of claim 6, wherein a number of circuits of the at least one of the circuits isolated within the condenser varies with a difference between the measure pressure and the predetermined pressure.

13. A heating, ventilation and air conditioning system comprising:

a compressor, an evaporator, and a condenser connected in a closed refrigerant loop;

a refrigerant pressure sensor to measure refrigerant pressure, the refrigerant pressure sensor being disposed at predetermined location within the system;

the condenser including a plurality of refrigerant circuits, a first valve arrangement and a second valve arrangement;

the first valve arrangement arranged and disposed to selectively isolate one or more of the refrigerant circuits from flow of refrigerant;

wherein the first valve arrangement is further arranged and disposed to increase the refrigerant pressure in the closed refrigerant loop by selectively drawing refrigerant into the closed refrigerant loop from at least one of any refrigerant circuits isolated from flow of refrigerant;

wherein the first valve arrangement is further arranged and disposed to decrease the refrigerant pressure in the closed refrigerant loop by selectively drawing refrigerant from the closed refrigerant loop into at least one of any refrigerant circuits isolated from flow of refrigerant; and wherein the second valve arrangement is arranged and disposed to draw refrigerant into or out of the one or more isolated refrigerant circuits of the condenser in response to the measured refrigerant pressure to maintain a predetermined system pressure.

14. The system of claim 13, wherein the first valve arrangement isolates the one or more refrigerant circuits to reduce the heat transfer area of the condenser.

15. The system of claim 13, wherein the second valve arrangement permits fluid communication of the one or more isolated refrigerant circuits with an inlet of the compressor.

16. The system of claim 13, wherein the first valve arrangement includes one or more valves configured and disposed in the system to independently isolate one or more of the refrigerant circuits from flow of refrigerant.

17. The system of claim 13, wherein the one or more isolated refrigerant circuits are arranged and disposed in locations across a surface of the condenser that receive a reduced flow of heat transfer fluid during operation.

18. The system of claim 17, wherein the one or more isolated refrigerant circuits are arranged and disposed at locations at or near edges of the surface of the condenser.

19. The system of claim 13, wherein the first valve arrangement and second valve arrangement comprise a single inlet header.

20. The system of claim 13, wherein the first valve arrangement and second valve arrangement comprise a plurality of inlet headers.

21. The system of claim 13, wherein the first valve arrangement and second valve arrangement comprise a single outlet header.

22. The system of claim 13, wherein the first valve arrangement and second valve arrangement comprise a plurality of outlet headers.

* * * * *